US011286092B2

(12) United States Patent
Porte et al.

(10) Patent No.: US 11,286,092 B2
(45) Date of Patent: Mar. 29, 2022

(54) SAFEGUARDING DEVICE DESIGNED TO SECURE A CONTAINER

(71) Applicant: COMMISSARIAT A L'ENERGIE ATOMIQUE ET AUX ENERGIES ALTERNATIVES, Paris (FR)

(72) Inventors: Florian Porte, Grenoble (FR); Norbert Daniele, Bernin (FR); Jean-François Mainguet, Grenoble (FR); Pierre-Henri Thevenon, Bas-en-Basset (FR); Roland Pelisson, La Terrasse (FR); Nicolas Bouquet, Saint-Egrève (FR)

(73) Assignee: COMMISSARIAT A L'ENERGIE ATOMIQUE ET AUX ENERGIES ALTERNATIVES, Paris (FR)

( * ) Notice: Subject to any disclaimer, the term of this patent is extended or adjusted under 35 U.S.C. 154(b) by 490 days.

(21) Appl. No.: 15/487,672

(22) Filed: Apr. 14, 2017

(65) Prior Publication Data

US 2017/0297790 A1 Oct. 19, 2017

(30) Foreign Application Priority Data

Apr. 15, 2016 (FR) ..... 1653343

(51) Int. Cl.
*B65D 55/02* (2006.01)
*B65D 39/00* (2006.01)
*B65D 1/02* (2006.01)

(52) U.S. Cl.
CPC ..... *B65D 55/028* (2013.01); *B65D 1/023* (2013.01); *B65D 39/0005* (2013.01);
(Continued)

(58) Field of Classification Search
CPC .. B65D 55/028; B65D 1/023; B65D 39/0005; B65D 39/0052; B65D 2203/10
See application file for complete search history.

(56) References Cited

U.S. PATENT DOCUMENTS 4,736,857 A 4/1988 Monico, Jr. et al.
8,040,244 B2 * 10/2011 Bauchot ..... B65D 55/028 340/568.1

(Continued)

FOREIGN PATENT DOCUMENTS

FR 2 767 515 A1 2/1999
WO 03/082696 A1 10/2003
WO 2015/091597 A1 6/2015

OTHER PUBLICATIONS

French Search Report and Written Opinion dated Oct. 25, 2016 issued in counterpart application No. FR1653343 w/ English partial translation and partial machine translation (16 pages).

*Primary Examiner* — Benyam Haile
(74) *Attorney, Agent, or Firm* — Seckel IP, PLLC

(57) ABSTRACT

The bottle has a neck sealed by a stopper. The safeguarding device (2) comprises a first and a second part (20, 21), the first part (20) being adapted to be integrated in the stopper (1) and the two parts (20, 21) being joined in translation while allowing a limited relative movement of one part with respect to the other when a traction force is applied to the safeguarding device (2) in order to remove said stopper (1) from the neck. According to the invention, the safeguarding device comprises an electrical component (212) disposed so that at least one electrical characteristic of said component is modified during the relative movement of the two parts (20, 21).

14 Claims, 7 Drawing Sheets

(52) U.S. Cl.
CPC ..... *B65D 39/0052* (2013.01); *B65D 55/02* (2013.01); *B65D 2203/10* (2013.01)

(56) References Cited

U.S. PATENT DOCUMENTS

| | | | | |
|---|---|---|---|---|
| 2005/0110647 | A1* | 5/2005 | Ritson | B65D 51/248 340/686.1 |
| 2007/0096918 | A1 | 5/2007 | Badillo et al. | |
| 2010/0117797 | A1 | 5/2010 | Bauchot et al. | |
| 2014/0138276 | A1 | 5/2014 | Smith et al. | |
| 2016/0198246 | A1* | 7/2016 | Gurumohan | G06Q 10/087 340/870.02 |
| 2017/0316302 | A1* | 11/2017 | Clere | G06K 19/07798 |
| 2018/0276522 | A1* | 9/2018 | Coronado | G06K 19/07726 |

* cited by examiner

SAFEGUARDING DEVICE DESIGNED TO SECURE A CONTAINER

This application claims priority of French application No. FR1653343 filed Apr. 15, 2016, the content of which is hereby incorporated by reference herein in its entirety.

TECHNICAL FIELD OF THE INVENTION

The invention relates to a device for sealing a container having a neck, and a container having a neck sealed by such a device.

PRIOR ART

The market of high-end wines and spirits is a victim of counterfeiting and fraud. One common fraud, known as "refilling", involves recycling bottles of genuine high-value wines or spirits, refilling these bottles with a wine or spirit of lesser quality, then sealing them with the aid of stoppers, sometimes the original stoppers.

In this context, the producers of wines and spirits are seeking to develop solutions for protection and safeguarding of the bottles. One goal in particular is to detect the first opening of a bottle in order to guarantee to the consumer that the stopper has not already been opened.

Many safeguarding solutions for bottles are based on the use of a radio-identification label or RFID. The RFID label comprises an electronic chip storing information about the product (that is, the bottle and its contents) or a simple identifier allowing this information to be retrieved by connecting to a distant server, as well as data enabling a verification of the authenticity of this product information, and an antenna, the whole of this being arranged on a thin support. Thanks to this label, one can easily verify the authenticity of the product and rest assured that the bottle has not been previously opened. It is enough to have a NFC (Near Field Communication) reader, integrated for example in a smartphone or in any other NFC equipment, and scan the chip integrated in the label. If the label is intact, the chip confirms that the product has not been counterfeited and that the stopper has not been removed.

It is known how to mechanically deactivate the RFID label during the first opening of the bottle, which prevents a further reusing of the stopper, for example, to cap the bottle after "refilling" or to authenticate the content of another bottle. In order to deactivate the label mechanically, it is enough to damage it so as to cause the breakage of the chip and/or the antenna and/or a specific electrical track.

The document WO2015091597 describes a device for sealing a container having a neck or spout, outfitted with a RFID label and a mechanism for mechanical deactivation of the label upon first opening of the container. The sealing device consists of two parts:

- a first part forming a stopper, designed to seal the neck in a tight manner,
- a second part having the form of a cap, wider than the neck, designed to be arranged on the outside of the neck.

The two parts are joined together while allowing a limited relative movement, for a maximum distance d, of one of the parts relative to the other one when a traction force is applied to this part in order to remove the sealing device. The RFID label is attached to the stopper part. A rod joined by one of its ends to the cap part and having at its other end a perforating punch is provided to mechanically damage the label during the first opening of the container. When a person attempts to unseal the container, he will exert a traction force on the cap. This force at first has the effect of removing the cap part from the stopper part, until the cap abuts against a support zone of the stopper part. Once the abutment has been accomplished, the two parts move together under the traction force to uncap the container. The first relative movement of the cap part with respect to the stopper part causes the punch to move and pierce the RFID label, thus bringing about the breakage of the chip and/or the antenna, having the effect of mechanically deactivating the label.

Such a solution relies on the mechanical destruction of the RFID label, which has in particular the drawback of preventing its subsequent reading.

The present invention proposes a device for sealing a container having a neck adapted to detect a first opening of the container in a non-destructive manner.

SUBJECT OF THE INVENTION

Toward this end, the invention relates to a safeguarding device designed to safeguard a container, especially a bottle containing a wine or spirit, having a neck sealed by a stopper, said safeguarding device comprising a first and a second part, the first part being adapted to be integrated in the stopper and the two parts being joined in translation while allowing a limited relative movement of one of the parts with respect to the other when a traction force is applied to the safeguarding device in order to remove said stopper from the neck, characterized in that it comprises an electrical component disposed so that at least one electrical characteristic of said component is modified during the relative movement of the two parts.

In this safeguarding device, the electrical component is a piezoelectrical component or a LC circuit.

In a first embodiment, the piezoelectrical component is integrated in one of the two parts, designed to be mechanically deformed by the other part, especially by an excitation element integrated in the other part, during the relative movement of the two parts, so as to generate an electrical signal. Moreover, since the piezoelectrical component is integrated in the safeguarding device, the integrity of the sealing stopper is preserved and there is no risk of degrading its quality.

Advantageously, the second part is mounted on an axis joined to the first part and able to move in translation for a limited distance along said axis.

Again advantageously, the second part is free in rotation around said axis. This forces the user who wants to remove the stopper provided with the safeguarding device from the neck of the container to perform a traction gesture along an axial direction.

In one particular embodiment, the excitation element comprises a washer, joined to the axis of the first part, and the piezoelectrical component is carried by the second part, the washer and the piezoelectrical component being adapted to cooperate so that the piezoelectrical component is mechanically deformed by the washer during its passage in front of said washer, during the relative movement of the two parts.

Advantageously, the second part is adapted to abut against the washer at the end of the relative movement of the two parts.

Again advantageously, the piezoelectrical component is in the form of a thin strip extending in a plane orthogonal to the axis of the first part and said strip is integrated with the second part.

In a first variant embodiment, the piezoelectrical component is connected to a microcontroller designed to count the number of openings and/or closings of the container based on the electrical signal generated by the piezoelectrical component during each mechanical deformation.

Advantageously, the microcontroller is electrically powered by the piezoelectrical component.

In a second embodiment, one of the two parts comprises a first capacitor plate and the other part comprises a second capacitor plate and a coil, said coil and the two capacitor plates forming the LC circuit, the two capacitor plates being disposed so that the distance between them is modified during the relative movement of the two parts.

Advantageously, the first capacitor plate belongs to the first part and the second capacitor plate and the coil belong to the second part.

In one variant embodiment, the device comprises an anti-return system to prevent a return of the two parts to the initial closure position.

Advantageously, the device comprises a support ring for the coil winding.

Again advantageously, the internal wall of said support ring carries at least one anti-return flange.

The support ring has two openings, one of the openings may have an internal support edge acting as an abutment for the first capacitor plate and the other opening may be closed by the second capacitor plate.

The first capacitor plate can be assembled on a cylindrical portion, the assembly forming a cap designed to be fitted on one end of the stopper.

The invention also relates to a secure sealing device for a container having a neck, comprising a stopper designed to seal said neck, and a safeguarding device as defined above, assembled on the stopper.

The invention further relates to a container comprising a neck and a secure sealing device as defined above, sealing said neck.

In one particular embodiment, the container is in the form of a bottle. It may contain a wine or spirit.

BRIEF DESCRIPTION OF THE DRAWINGS

The invention will be understood better with the aid of the following description of various embodiments of the safeguarding device of a container and of the secure sealing device according to the invention, making reference to the enclosed drawings, in which.

DETAILED DESCRIPTION OF PARTICULAR EMBODIMENTS OF THE INVENTION

Figure 1:
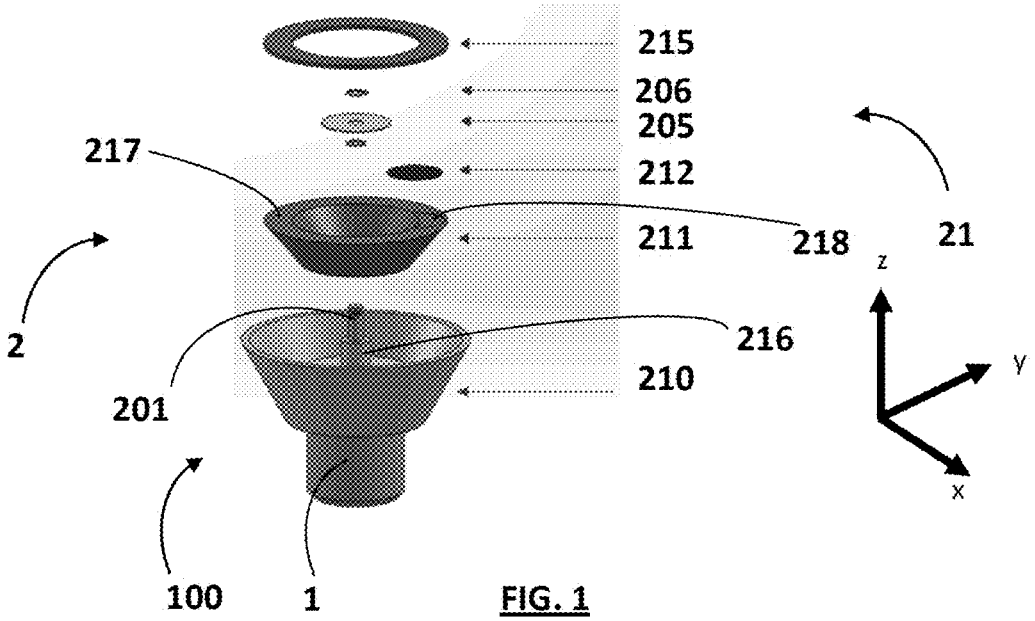
FIG. 1 represents an exploded view of various elements making up a secure sealing device according to a first embodiment of the invention, comprising a stopper of the container and a safeguarding device for the container.

The safeguarding device of the invention is designed to secure a container having a neck, such as a bottle containing a liquid such as a wine or spirit. It is adapted to be assembled onto a stopper 1, or sealing device, designed to seal, preferably in a tight manner, the neck of the container. The assembly comprising the stopper and the safeguarding device forms a secure sealing device for the container. The stopper 1 here has a cylindrical shape. It can be made of cork or synthetic material.

The safeguarding device comprises two parts, known as "first" part and "second" part. These two parts are joined in translation while allowing a limited relative movement of one of the parts with respect to the other when a traction force is applied to the safeguarding device in order to remove the stopper from the neck. According to the invention, the safeguarding device comprises an electrical component adapted so that an electrical characteristic of this component is modified during the relative movement of the two parts, as shall be explained in a more detailed manner below. The purpose of the device is to detect a first opening. However, in certain embodiments, the device can be designed to count the number of openings, and optionally the number of closings.

First of all, it will be noted that identical or corresponding elements represented in the different figures carry the same references, unless otherwise indicated. Moreover, in each of the FIGS. 1 to 8 there is represented an orthonormalized reference (x, y, z) associated with the safeguarding device.

In a first embodiment, represented in FIGS. 1 to 5 and 6A to 6D, the safeguarding device 2 comprises a first part 20 and a second part 21. The electrical component is a piezoelectrical component 212, designed to be mechanically deformed upon relative movement of the two parts 20, 21 of the safeguarding device 2 and to generate an electrical signal under the action of this mechanical deformation. The piezoelectrical component 212 is adapted so that an electrical characteristic of this component, in the present case the electrical signal generated by this component, is modified upon relative movement of the two parts 20, 21 of the safeguarding device 2. The piezoelectrical component 212 is integrated with one of the two parts of the safeguarding device 2, here, the second part 21, and designed to be deformed by an excitation element, or piece, integrated in the other part of the safeguarding device 2, here, the first part 20.

Figure 3:
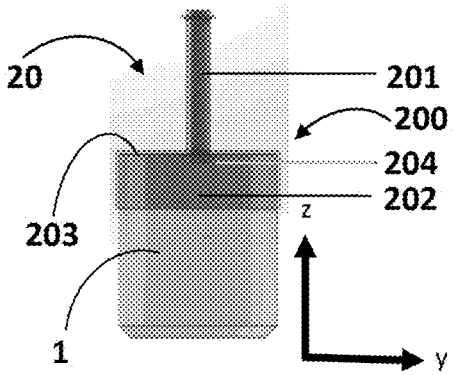
FIG. 3 represents a side view of a lower portion of the safeguarding device mounted on the stopper of the sealing device of FIG. 1.
Figure 4:
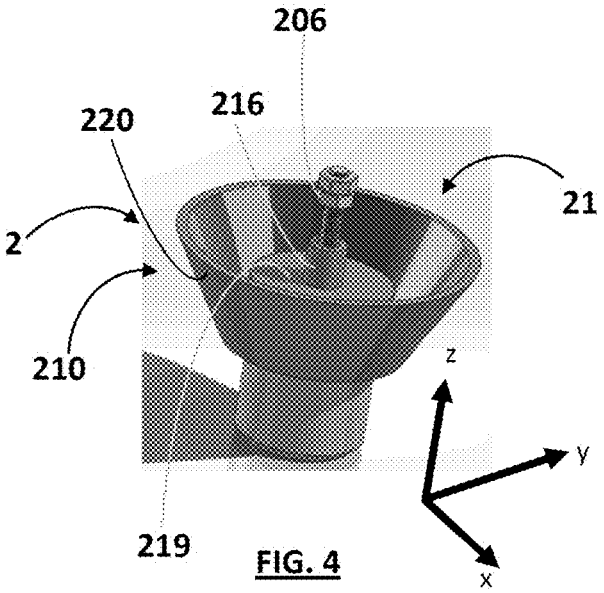
FIG. 4 represents a perspective view of a cap element of an upper portion of the safeguarding device, mounted on the lower portion of FIG. 3, the cap element being in a low position.
Figure 5:
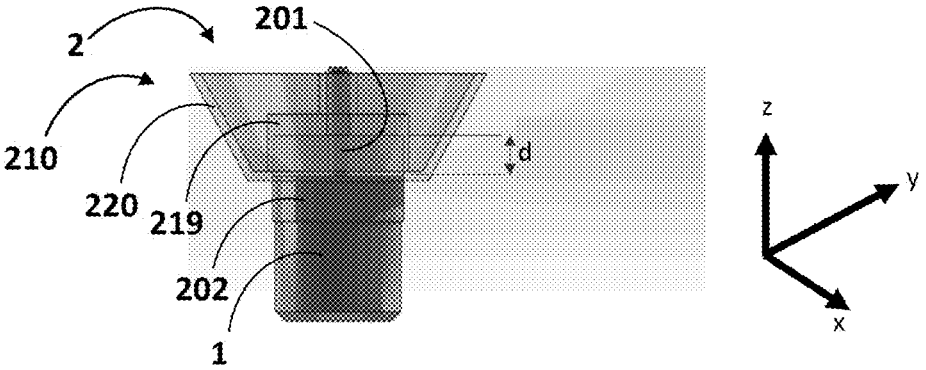
FIG. 5 represents a side view of the assembly of FIG. 4, in see-through form, the cap element being in a high position.

Referring to FIG. 3, the first part 20 of the safeguarding device 2 comprises a cylindrical portion 200 and an axis of fixation 201. The cylindrical portion 200 comprises a cylindrical lateral wall 202 and a bottom 203, forming a cap designed to be fitted onto the stopper 1. The wall 202 and the bottom 203 delimit an interior space forming a seat designed to receive one of the ends of the stopper 1, namely, the end designed to face the outside of the container.

The axis of fixation 201 is joined to the bottom 203 of the cylindrical portion 200 and extends from the opposite side to the seat for receiving the stopper. The cylindrical portion 200 and the axis of fixation 201 are coaxial.

One of the ends of the axis of fixation 201, known as the "lower end", passes through the bottom 203 of the cap and projects slightly into its interior. This lower end of the axis 201 is designed to be introduced into a cavity of complementary shape, devised in the end face of the stopper 1 which is designed to face the outside of the container.

In one variant embodiment, the axis 201 and the cylindrical portion 200 form a single piece. In this case, the axis 201 does not project into the interior of the cylindrical portion 200.

The other end of the axis of fixation 201, known as the "upper end", carries an excitation washer, or circlip 205. This washer provides a central opening to receive the axis of fixation 201. It is secured to the axis 201 by any suitable means of fixation, for example clamping nuts 206, such as those represented in FIG. 4. The excitation washer 205 has two functions: a) to serve as an end stop for the movement of translation, b) to excite the piezoelectrical component 212. For function b), the washer 205 is designed to mechanically deform the piezoelectrical component 212 during the relative movement of the two parts 20 and 21, as shall be explained further below. It needs to be able to be secured after the assembly of the parts 20 and 21.

The second part 21 is mounted on the axis of fixation 201. It can move in translation over a limited distance d along this axis of fixation 201. Advantageously, it is also free in rotation around the axis of fixation 201.

In other words, in this configuration, this second part 21 is mounted to be integrated in (or connected with) the first part 20 while being:

- movable in translation over the limited distance d along a central axis which is common to these two parts 20, 21, and/or
- movable in rotation around this central axis which is common to these two parts 20, 21.

The second part 21 of the safeguarding device 2 comprises the following elements:

- a cap 210 adapted to be fitted onto the first part 20;
- the piezoelectrical component 212;
- a barrel 211 supporting the piezoelectrical component 212;
- a clamping ring 215 for the piezoelectrical component 212;
- a locking sleeve 216.

In one variant embodiment, the two parts 211 and 215 are replaced by a single piece, providing an insertion slot for the piezoelectrical component 212.

The cap 210 comprises an internal cylindrical portion 219, designed to fit onto or into the cylindrical portion 200 of the first part 20 and surrounded by an external wall 220, such as a truncated cone flaring toward the top (that is, in the direction opposite the direction of fitting of the second part 21 onto the first part 20). However, this external wall 220 could be cylindrical or some other shape. The internal cylindrical portion 219 comprises a cylindrical lateral wall and an upper bottom providing a central opening to receive the axis of fixation 201. The external truncated conical wall 220 and the internal cylindrical portion 219 between them produce a throat. The upwardly flaring truncated conical shape of the external wall 220 makes it easier for the user to grasp the secure sealing device in order to open the bottle. The external truncated conical wall 220 has a height greater than that of the internal cylindrical portion 219. The cylindrical portion 219 is surmounted by the locking sleeve 216. This is intended to abut against the washer 205, here, by means of one of the clamping nuts 206 of said washer 205 (the one located beneath the washer), at the end of the relative movement of the two parts 20 and 21 when a user exerts a traction force on the secure sealing device 100 in order to remove it from the neck of the container. The total height of the cylindrical portion 219 and the sleeve 216 is equal here, or substantially equal, to the height of the external truncated conical wall 218.

As a variant, the part 21 does not comprise a sleeve 216 around the axis. The lower part 21 can abut directly against the upper part 20. The sleeve 216 simply allows a regulating of the travel between the two movable parts 20, 21 of the safeguarding device 2.

The support barrel 211 has the function of bearing the piezoelectrical component 212. It is integrated with the second part 21 of the safeguarding device 2 and adapted to let the piezoelectrical component 212 pass in front of the washer 205 during the relative movement of the two parts 20, 21 of the safeguarding device 3, as shall be explained further below. In the exemplary embodiment described here, the support barrel 211 comprises a circular bottom and a truncated conical lateral wall having, at its free end, an annular rim 217 to support the piezoelectrical component 212. The annular rim 217 has a notch 218 to receive a portion of the piezoelectrical component 212. The bottom of the barrel 211 provides a central opening to receive the locking sleeve 216. The truncated conical lateral wall of the barrel 211 flares from the circular bottom to the annular rim of the free end. The support barrel 211 is assembled on the cap 210 by inserting the sleeve 216 through the central opening of the bottom of the barrel 211 and then by securing, for example by bonding, the bottom of the barrel 211 to the bottom of the cylindrical portion 219 (the lower face of the bottom of the barrel 211 being bonded to the upper face of the bottom of the cylindrical portion 219). The bonding between the bottom of the barrel 211 and the bottom of the cylindrical wall 219 should be durable and strong enough to prevent a lifting off when a traction force is applied to the safeguarding device 2 to remove the stopper 1 from the neck of the container. We note that the support elements of the piezoelectrical component could be structurally and/or geometrically different. For example, the pieces 210 (cap), 211 (barrel) and 215 (clamping ring) could form only a single monobloc piece having an insertion slot for the piezoelectrical component.

The piezoelectrical component 212 here is a thin strip of disc shape. It is pinched, or held in sandwich fashion, between the upper annular rim 217 of the barrel 211 and the clamping ring 215, of width equal to or substantially equal to that of the annular rim of the barrel 211. The ring 215 is secured to the annular rim 217 of the barrel 211 by bonding, for example. The whole is adapted so that the piezoelectrical part 212 is effectively deformed when the washer 205 passes in front.

In the exemplary embodiment described here, the piezoelectrical component 212 is connected to a microcontroller (not shown) by means of a circuit (not shown) to recover and convert energy, designed to recover the electrical energy generated by the piezoelectrical component in the event of mechanical deformation of the latter and to shape or convert this energy in order to power the microcontroller. The latter is designed to count the number of openings and closings of the container.

Moreover, the safeguarding device 2 comprises a wireless communication component, here, an NFC (Near Field Communication) component or NFC tag. This NFC component may be integrated in the microcontroller. It comprises an electronic chip and an antenna, disposed on a thin support. The electronic chip can store information about the product contained in the container and data allowing a verification of the authenticity of this information. Moreover, the chip can store the number of openings and/or closings of the bottle, as detected by the microcontroller.

A nonvolatile memory register can memorize the number of openings and/or closings of the bottle. This register may be a register of the microcontroller (flash memory, EEPROM, etc.), or of the memory in the NFC tag. In the first case (memory register in microcontroller), the NFC tag is adapted to power the microcontroller and to read the memory register in the microcontroller. In the second case (memory register in the NFC tag), the microcontroller has access to the NFC tag, which assumes that this is also powered.

As a variant, the piezoelectrical component 212 could be connected to a transistor, or other component of the same type (such as a simple fuse), so as to gate this transistor with the electrical energy generated by the piezoelectrical component when it is deformed mechanically. In another variant, one can contemplate the use of a printed circuit or PCB (Printed Circuit Board) directly attached to the cap 210, in the place of the pieces 215/218, and to solder the piezoelectrical component to this printed circuit. This printed circuit could have a ring shape. It could likewise integrate the circuit for recovery of energy, the microcontroller, the NFC component and the antenna.

We shall now describe the operation of assembling the various elements of the secure sealing device 100.

In a first step E1, one of the ends of the stopper 1 (the one designed to face the outside of the container) is introduced into the seat, or cavity, for receiving the cylindrical portion 200 of the first part 20 of the safeguarding device 2. The diameter of the cylindrical portion 200 is slightly less than that of the stopper 1, so that the portion of the end of the stopper 1 which is introduced into the cylindrical portion 200 is slightly compressed, ensuring the holding of the stopper 1. In an alternative or supplemental manner, the holding of the stopper may be ensured by bonding.

In a second step E2, the assembly comprising the stopper 1 and the first part 20 of the safeguarding device 2 is fitted with the cap 210 of the second part 21 of the safeguarding device 2. For this, one introduces the end of the stopper 1 having the cylindrical portion 200 into the cylindrical portion 217 of the cap 210, making the axis, or the rod 201 pass through the opening devised in the bottom of the cylindrical portion 217 and the sleeve 216, until the bottom of the cylindrical portion 200 abuts against the bottom of the cylindrical portion 217 of the cap 210. One thus fits the cylindrical portion 200 of the first part 20 of the safeguarding device 2 into the cylindrical portion 217 of the second part of the safeguarding device 2, while introducing the axis 201 into the sleeve 216. The two parts 20 and 21 are thus nested together. One can advantageously slightly bond the respective bottoms of the cylindrical portions 200 and 217, with the help of a layer of not very strong glue adapted to allow a later easy lifting off when a traction force is applied to the cap 210 in order to remove the stopper 1 from the neck of the container. This allows the two parts 20 and 21 to remain assembled in the "initial" position, in which the respective bottoms of the cylindrical portions 200 and 217 are contiguous, and to avoid any unwanted relative movement of the two parts 20 and 21.

In a third step E3, the support barrel 211 is fixed to the cap 210, here by bonding. For this purpose, the sleeve 216 is introduced through the central opening in the bottom of the barrel 211 until the bottom of the barrel 211 abuts against the bottom of the cylindrical portion 217 of the cap 210. The respective bottoms of the barrel 211 and of the cylindrical portion 217 are joined, here by bonding with the help of a layer of sufficiently strong glue to hold the two bottoms bonded to each other during the openings and closings of the container. Of course, in the event that the elements 210, 211 and 215 form a monobloc piece, step E3 is not carried out.

In a fourth step E4, the piezoelectrical component 212 is secured to the barrel 211 by pinching it between the annular rim of the barrel 211 and the clamping ring 215, which is joined to the annular rim, here by bonding.

Finally, in a fifth step E5, the excitation washer 205 is secured to the axis 201. For this purpose, the washer 205 could be held in sandwich manner between the two nuts 206 screwed into the free end portion of the axis 201. As a variant, the excitation washer can likewise be formed by a circlip adapted to be seated in a throat located at the free end of the axis 201. The washer 205 extends in a plane orthogonal to the axis 201.

Figure 2:
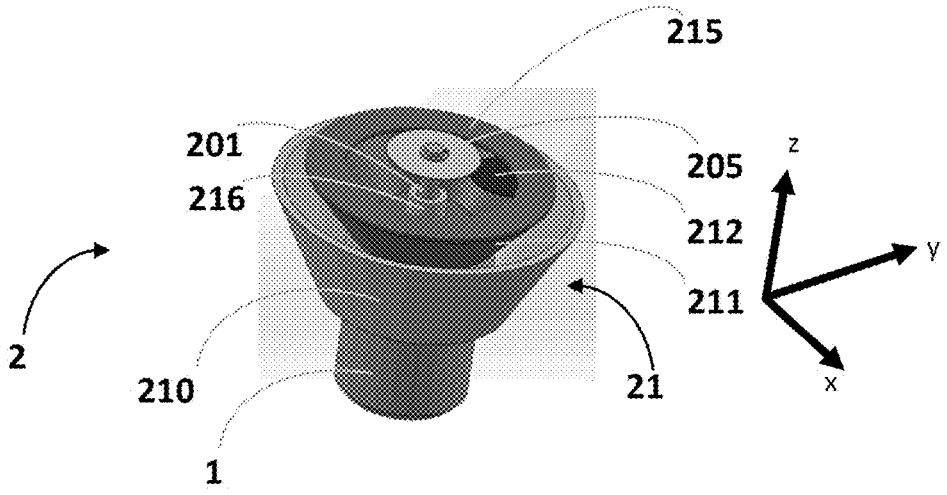
FIG. 2 represents a perspective view of the secure sealing device of FIG. 1, after assembly of the various elements.

In initial position, the end of the axis 201 with the excitation washer 205 projects outside the barrel 211, above the latter, in the direction z, as shown in FIG. 2. The piezoelectrical component 212 extends in a plane orthogonal to the axis 201, being interposed between the washer 205 and the bottom of the barrel 211. It is thus located beneath the washer 205 in the direction z.

In order to close a container having a neck, such as a bottle containing a wine or spirit, the stopper 1 provided with the safeguarding device 2 is partly introduced into the neck of the container, so as to seal the neck in tight fashion. The safeguarding device 2 and the portion of the stopper carrying it project outside of the neck.

A manoeuvre for opening the container whose neck is sealed by the stopper 1 provided with the safeguarding device 2 will now be described with reference to FIGS. 6A to 6D.

Figures 6A, 6B, 6C, 6D:
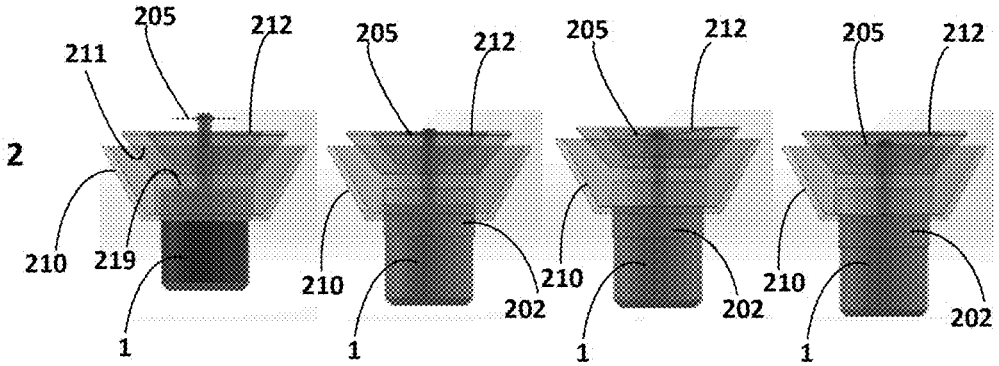
FIGS. 6A to 6D represent, in side view and see-through form, the secure sealing device of FIGS. 1 and 2, in different relative positions of the lower portion and the upper portion of the safeguarding device, to move from a retracted closure position to a deployed opening position.

At the start, in an initial step E10, the safeguarding device 2 is in an initial closure position as represented in FIG. 6A: the respective bottoms of the cylindrical portions 200 and 217 bear against each other, being contiguous. In this position, the piezoelectrical component 212 extends in a plane located between the washer 205 and the bottom of the barrel 211, beneath the washer 205 in reference to FIG. 6A. Before the first opening of the bottle, the respective bottoms of the cylindrical portions 200 and 217 are slightly bonded together.

When a user wishes to open the container, in the present instance the bottle of wine or spirits, he exerts a traction force on the secure sealing device 2, in a step E11. The force is directed along the direction z so as to remove the stopper 1 from the neck, upward in FIGS. 6A to 6D. For this purpose, the user positions several of his fingers for example on the exterior face of the cap 210 and pulls upward to remove the stopper from the neck. The truncated conical shape of the cap 210 improves the grip during the traction force.

We note that since the second part 21 is free in rotation around the axis 201 of the first part 20, the user must necessarily perform a traction gesture along the direction z in order to open the container.

Under the action of the traction force, in the case of a first opening, the respective bottoms of the cylindrical portions 200 and 217 lift off from each other, during a step E12.

First of all, during a step E13, under the action of the traction force, the second part 21 of the safeguarding device 2 moves along the direction z, in the direction of the traction force (that is, upward in FIG. 6B), relatively to the first part 20, which remains held in position inside the neck of the bottle, for a maximum distance d. Thus, when a traction force is applied to the safeguarding device 2 to remove the secured stopper 1 from the neck, this produces a limited relative movement of the part 21 with respect to the part 20 of the safeguarding device 2.

The relative movement of the two parts 20 and 21 causes the piezoelectrical component to be displaced relative to the washer 205 and to pass in front of it, striking it, which has the effect of mechanically deforming the piezoelectrical component 212, in a step E14. FIGS. 6B and 6C show intermediate positions during the relative movement of the two parts 20 and 21, in which the piezoelectrical component 212 and the washer 205 are bearing against each other. In FIG. 6B, the piezoelectrical component 212 has just made contact with the washer 205. Next, it continues to be displaced in the direction of the traction force (upward) and is deformed mechanically by the bearing of a peripheral edge of the piezoelectrical component 212 against a peripheral edge of the washer 205, as shown in FIG. 6C. During this phase of bearing of the component 212 against the washer 205, since the component 212 is at the same time in relative displacement with respect to the washer 205, the component 212 is progressively twisted and curves downward. Then, at the end of the relative displacement of the piezoelectrical component 212, the contact between the washer 205 and the piezoelectrical component 212 is broken and the piezoelectrical component 212 suddenly regains its initial planar shape.

The deformation of the piezoelectrical component 212 generates an electrical signal, here, an electrical voltage, during a step E15. This electrical signal serves here to power the microcontroller electrically, by means of the circuit for recovery and conversion of energy. Furthermore, upon receiving the electrical signal, the microcontroller detects an opening of the container, in the present instance, the bottle, and registers the information in memory, keeping track of the number of openings for example by incrementing a corresponding value. The microcontroller is adapted to start when its power supply voltage passes a certain threshold. When the electrical voltage generated by the deformation of the piezoelectrical component passes this threshold, the microcontroller initiates a cold start (or "hard reset") procedure, in which the incrementing of a memory register is programmed. Thus, the memory register is incremented by one during each starting of the microcontroller caused by the deformation of the piezoelectrical component.

At the end of the relative movement of the two parts 20 and 21 of the sealing device 2, the sleeve 216 abuts against the washer 205, by means of the lower nut 206, as represented in FIG. 6D, during a step E16. In this position of end of relative movement, the bottom of the cylindrical portion 217 of the cap 210 is at a distance d from the bottom 200 of the part 20. Moreover, the piezoelectrical component 212 is positioned beyond the excitation washer 205 (above the latter in FIG. 6D). Once the sleeve 216 abuts against the washer 205, the two parts 20 and 21 of the safeguarding device 2 are joined in translation in the direction of the traction force (that is, upward in FIG. 6D).

After the relative movement of the two parts 20 and 21 of the sealing device 2 (step E13) and the abutting of the two parts against each other (step E16), under the action of the traction force applied to the safeguarding device 2, the stopper 1 is displaced in the direction of the traction force (upward in FIG. 6D) and is extracted from the neck as far as its opening, during a step E17. The traction force needed to release the safeguarding device (that is, to place the two parts 20 and 21 in movement relative to one another) should be greater than the weight of the bottle, so as to prevent a false detection of an opening if the bottle is merely held by the upper part 21, and less than the unstoppering force, which is preferably greater than 45N.

We note that the steps E13 to E17 are concomitant with step E12, consisting of the applying of a traction force to the safeguarding device.

After opening, the container can be closed with the aid of the stopper 1 provided with the safeguarding device 2. The sealing of the neck of the container with the aid of the stopper 1 provided with the safeguarding device 2 likewise causes a mechanical deformation of the piezoelectrical component 212 and consequently the generation of an electrical signal. This allows the microcontroller to also keep track of the closings. The closing manoeuvre takes place as described below. Initially, the sealing device 2 is in a configuration, or arrangement, similar to that shown in FIG. 6D: the piezoelectrical component 212 is positioned above the excitation washer 205, possibly in contact with it yet without deformation. The user at first lightly pushes the stopper 1 into the neck to be sealed, then applies to the safeguarding device 2 of the stopper 1 a thrusting force so as to seat the stopper 1 in the neck.

First of all, under the action of the thrusting force, the second part 21 of the safeguarding device 2 is displaced in the direction z, in the direction of the thrusting force (that is, downward) relative to the first part 20. The relative movement of the part 21 with respect to the part 20 of the sealing device 2 causes the piezoelectrical component 212 to be displaced relative to the washer 205 and to pass in front of it, striking it, which has the effect of mechanically deforming the piezoelectrical component 212. Moving in the direction of the thrusting force (here, downward), the piezoelectrical component 212 is deformed mechanically by peripheral bearing against the washer 205. During this phase of bearing of the component 212 against the washer 205 and relative displacement of the component 212 with respect to the washer 205, the component 212 is progressively twisted and curves upward. Then, the contact between the washer 205 and the piezoelectrical component 212 is broken and the piezoelectrical component 212 suddenly regains its initial planar shape.

This mechanical deformation of the piezoelectrical component 212 generates an electrical signal, here, an electrical voltage. This electrical signal serves here to power the microcontroller electrically, by means of the circuit for recovery and conversion of energy. Furthermore, upon receiving the electrical signal, the microcontroller detects a closing of the bottle, and registers the information in memory, in order to keep track of the number of closings, for example by incrementing a corresponding value.

We note that the direction of the electric current generated by deformation of the piezoelectrical component depends on the direction of its twisting, so that it is possible to determine whether the generated current corresponds to an opening or a closing of the bottle.

Otherwise, upon generation of an electric signal by deformation of the piezoelectrical component, the microcontroller does not know if this signal corresponds to an opening or a closing. In this case, it can count overall the number of openings and closings. This total number of openings and closings can optionally be divided by two in order to deduce the effective number of openings and/or the effective number of closings.

At the end of the relative movement of the two parts 20 and 21 of the sealing device 2, the bottom of the cylindrical portion 217 of the cap 210 bears against the bottom of the cylindrical portion 200 of the part 20 of the sealing device 2. Once these two respective bottoms of the parts 20 and 21 are bearing against each other, the two parts 20 and 21 are joined in translation in the direction of the thrust force (that is, downward).

We emphasize that the safeguarding device 2 has many advantages:

- the piezoelectrical component can be deformed and can generate an electric signal in a reproducible manner;
- it is able to keep track of the number of openings and/or closings of the container;
- the detection of an opening and/or a closing can operate in an autonomous manner, without external power supply, thanks to the energy generated by the piezoelectrical component;
- the detection of an opening and/or a closing does not require access to a database for purposes of comparing to an initial state;
- the stopper is preserved, since the safeguarding device does not modify its structure.
- since the cap 21 is free in rotation with respect to the stopper 1, the consumer is obliged to apply a traction force significantly greater than the one that would be applied with a rotation.

In the preceding description, the safeguarding device 2 comprises a piezoelectrical component 212. As a variant, it could comprise several piezoelectrical components, for example, distributed along the annular rim of the barrel 211.

Figure 7:
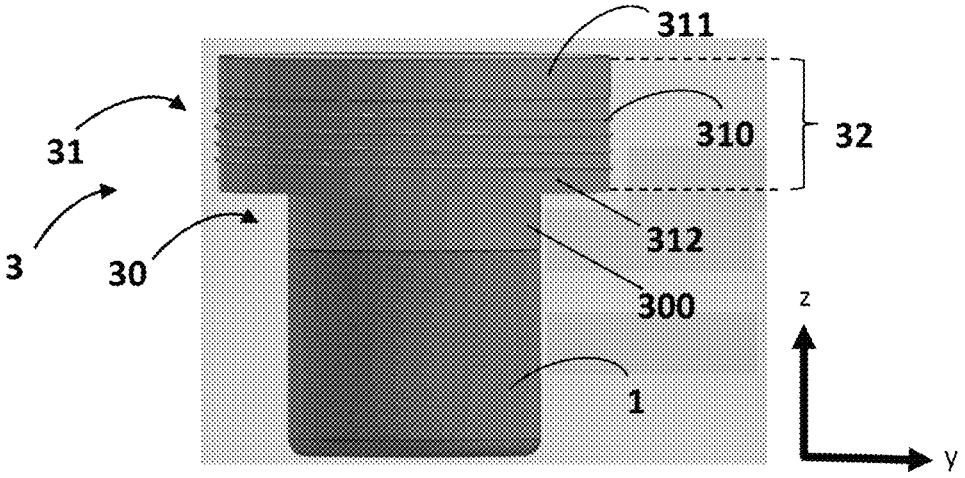
FIG. 7 represents, in side view, the secure sealing device of the invention in a second embodiment.
Figure 8:
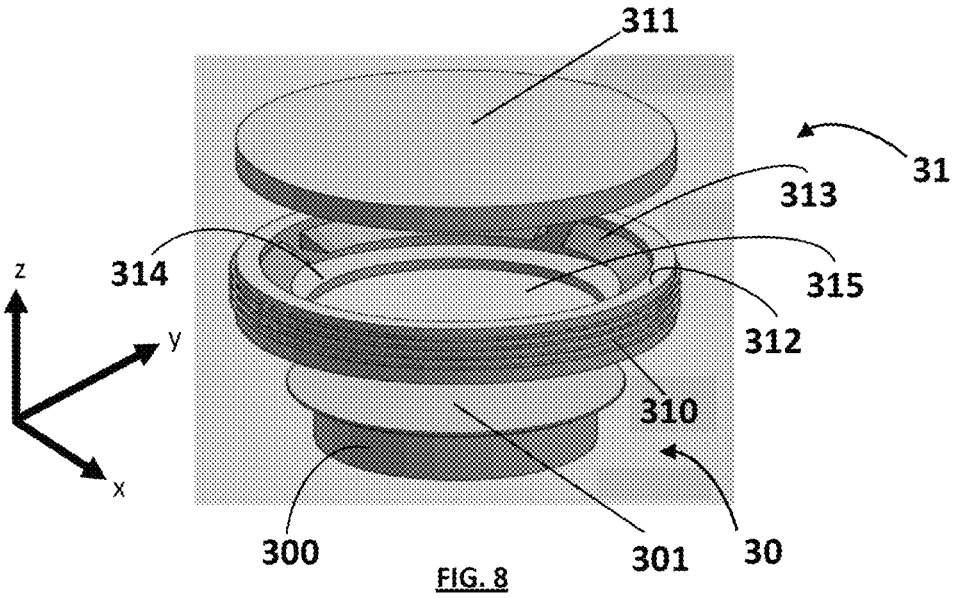
FIG. 8 represents an exploded view of the safeguarding device of the sealing device of FIG. 7.
Figure 9:
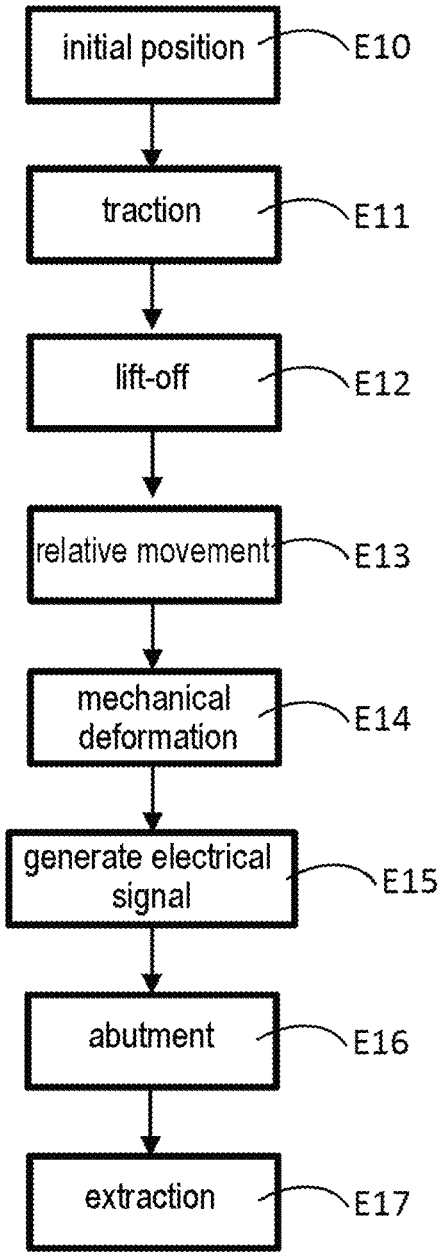
FIG. 9 represents a flow chart of the steps in the process of opening a container sealed with the aid of a stopper provided with the safeguarding device of FIG. 2.
Figure 10:
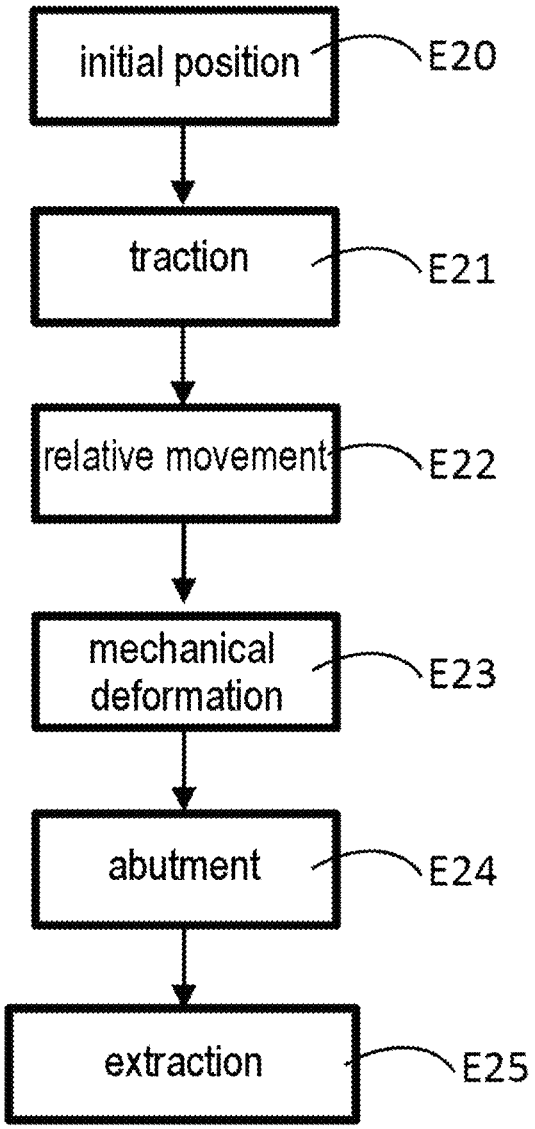
FIG. 10 represents a flow chart of the steps in the process of opening a container sealed with the aid of a stopper provided with the safeguarding device of FIG. 7.

A second embodiment of the safeguarding device of the invention—having reference 3—is presented in FIGS. 7 and 8. In this second embodiment, the electrical component is an LC circuit, as explained below.

The safeguarding device 3 comprises a first part 30 and a second part 31. The first part 30 comprises a first capacitor plate 301. The other part, or second part 31, comprises a coil 310 and a second capacitor plate 311. The capacitor plates 301, 311 are in disc shape and arranged facing one another. Each of the plates 301 and 311 is formed by a metallized surface carried by a support disc of circular shape. The coil 310 and the two capacitor plates 301, 311 form an LC circuit.

The first part 30 comprises a cylindrical portion 300, in the form of a ring, assembled on the capacitor plate 301. One of the annular edges of the ring 300 is fixed, for example by bonding, to the rear face of the plate 301 opposite its front face, which is positioned opposite the other plate 311. The assembly of the ring 300 and the capacitor plate 301 forms a cap designed to be fitted onto an end of the stopper 1 and delimits an interior space forming a seat designed to receive one of the ends of the stopper 1, namely, the one designed to face the outside of the container.

The safeguarding device 3 likewise comprises a support ring 312 for the coil winding 310. This support ring 312 comprises two openings, respectively upper and lower in terms of the direction z referenced in FIG. 8. One of the openings of the ring 312 (the lower opening in FIG. 8) has an internal annular support flange 314 acting as an end stop for the first capacitor plate 301. The other opening of the ring 312 (the upper opening in FIG. 8) is closed by the second capacitor plate 311. The latter is fixed, for example by bonding, to the upper annular rim of the ring 312, the diameter of the plate 311 being identical to the outer diameter of the ring 312.

The diameter of the plate 301 is substantially equal to, or slightly less than the interior diameter of the support ring 312 and greater than the diameter of the lower opening produced by the support flange 314.

The exterior diameter of the ring 300 for receiving the stopper 1 is substantially equal to or slightly less than the diameter of the lower opening bounded by the support flange 314, and less than the outer diameter of the support ring for the winding 312 and that of the capacitor plate 311. Thus, when the safeguarding device 3 is assembled on the stopper 1, as shown in FIG. 7, one obtains a secured stopper having a stopper head 32 formed by the assembly of the support ring for the winding 312 and the capacitor plate 311, being wider than the stopper 1.

In the embodiment described here, the safeguarding device 3 likewise comprises an anti-return system to prevent a returning of the two parts 30, 31 in relative initial closing position (before the first opening), at the end of a relative movement. In the example described here, the anti-return system comprises one or more anti-return flanges, for example, four anti-return flanges, carried by the internal wall of said support ring 312. Each flange has the shape of a ring portion and has an upper face tilted with respect to the axis z toward the support flange (that is, toward the bottom in FIG. 8), adapted to allow the passage of the capacitor plate 301 in one direction (from top to bottom in FIG. 8), and a lower anti-return surface which is orthogonal to the axis z in order to block/prevent a return of the capacitor plate 301 in the opposite direction (from bottom to top in FIG. 8). The anti-return flanges are made of a slightly flexible material.

Other anti-return systems can be contemplated. For example, one may contemplate providing a central axis passing through the plates and bearing an anti-return cone of small size, made of flexible material allowing the passage of one of the plates in one direction but not in the opposite direction. In another embodiment, the central cone may be replaced by fins positioned on the periphery of the plates.

When the two parts 30 and 31 are assembled with each other, the capacitor plate 301 is placed in the interior space or seat 315 bounded by the support ring 312, the support flange 314 and the other capacitor plate 311.

This second embodiment of the safeguarding device 3 has the following advantages:

- a low cost, since the safeguarding device 3 comprises only one coil connected to two metal surfaces constituting the capacitor plates:
- the safeguarding device 3 does not contain an electronic component, which is an advantage in terms of sanitation and recycling ability;
- the integration of the safeguarding device 3 in a stopper is easier and applicable to stoppers having various shapes, especially thanks to the size of the stopper head 32 being limited;
- the safeguarding device 3 is robust;
- the safeguarding device 3 has a long service life.

We shall now describe the functioning of the safeguarding device 3 which enables a detecting of a first opening of the neck of a container, such as a bottle of wine or spirits, sealed by a stopper 1 provided with this safeguarding device 3.

During a preliminary step, the stopper 1 is assembled on the safeguarding device 3, by introducing one of its ends into the ring 300, as shown in FIG. 7. Next, the stopper 1 is introduced partially into the neck of the bottle (or the container) so as to seal it in a tight manner. The stopper 1 is seated in the neck until the stopper head 32 abuts against the outer edge of the neck.

Initially, during a step E20, the safeguarding device 3 is in the initial closure position, that is, in the closure position prior to a first opening of the bottle (or the container). The capacitor plate 301 is thus arranged between the capacitor plate 311 and the tilted faces of the anti-return flanges 313, in other words above these anti-return flanges 313, in the upper part of the seat in FIG. 8. In this closure position, the distance between the two capacitor plates 301, 311 is equal to $d_1$. Consequently, the LC circuit formed by the capacitor comprising the two plates 301 and 311 and the coil 310 has a first resonance frequency $f_1$ (expressed in Hertz (Hz)) given by the following relation:

$$f_1 = \frac{1}{2\pi\sqrt{L \times C}} = \frac{1}{2\pi}\sqrt{\frac{d_1}{s \times S \times L}}$$

where:

S represents the surface opposite the capacitor plates 301 and 311 (expressed in square metres ($m^2$));

$d_1$ represents the distance between the two capacitor plates 301 and 311 in the initial closure position (expressed in metres (m));

∈ represents the permittivity of the dielectric (expressed in Farad/metre ($F \cdot m^{-1}$));

L represents the inductance of the coil (expressed in henry (H)).

When a user wishes to open the bottle (or container) sealed by the stopper 1 provided with the safeguarding device 3, he applies a traction force to the stopper head 32 (or in other words, to the second part 31 of the safeguarding device 3) in order to remove the stopper 1 from the neck, during a step E21. This traction force is directed along the axis z, upward in FIG. 7.

First of all, under the action of the traction force to remove the stopper from the neck, the second part 31 of the safeguarding device 3 moves relatively to the first part 30 of the safeguarding device 3, during a step E22. The stopper 1 fitted with the first part 30 remains held in a sealing position inside the neck. During the relative movement of the part 31 of the safeguarding device 3 with respect to the part 30 joined to the stopper 1, the two capacitor plates 301, 311 move away from each other. This causes the capacitor plate 301 to pass in front of the anti-return system 313, during a step E23. During this step E23, the capacitor plate 301 bears at the periphery against the tilted faces of the anti-return flanges 313. Under the action of this bearing, the anti-return flanges 313 curve slightly and move apart so as to let the plate 301 pass, then return to the initial position. Then, at the end of the relative movement of the two parts 30, 31, the capacitor plate 301 comes to bear against the support flange 314, during a step E24.

Once the plate 301 of the first part 30 of the safeguarding device 3 is bearing against the flange 314 of the second part 31 of the safeguarding device 3, the two parts 30 and 31 are joined in translation in the direction of the traction force (in other words, in the direction z, upward in FIG. 8).

To open the bottle (or the container), the user continues to apply a traction force to the safeguarding device 3. The two parts 30 and 31 having become joined in translation, the stopper 1 provided with the safeguarding device 3 is pulled and displaced in the direction of this traction force until it is extracted from the neck, in a step E25.

Later on, the user can close the bottle (or the container) with the stopper 1 provided with the safeguarding device 3. For this, he presses the stopper 1 into the neck of the bottle, applying a thrust force to the stopper head 32, until the latter comes to bear against the flange of the neck. Under the action of the thrust force, the second part 31 is displaced slightly with respect to the first part 30 of the safeguarding device, until the plate 301 abuts against the anti-return faces of the flanges 313. In this position, the distance between the two plates 301, 311 is equal to $d_2$ with $d_2 < d_1$.

In this position, the LC circuit formed by the capacitor comprising the two plates 301 and 311 and the coil 310 has a second resonance frequency $f_2$ (expressed in Hertz (Hz)) given by the following relation:

$$f_2 = \frac{1}{2\pi\sqrt{L \times C}} = \frac{1}{2\pi}\sqrt{\frac{d_2}{s \times S \times L}}$$

where:

S represents the surface opposite the capacitor plates 301 and 311 (expressed in square metres ($m^2$));

$d_2$ represents the distance between the two capacitor plates 301 and 311 in closure position after a first opening (expressed in metres (m));

∈ represents the permittivity of the dielectric (expressed in Farad/meter ($F \cdot m^{-1}$));

L represents the inductance of the coil (expressed in henry (H)).

We note that the LC circuit of the safeguarding device 3 is an electrical component adapted so that an electrical characteristic of this component, in the present case its resonance frequency, is modified upon the relative movement of the two parts 30, 31 of the safeguarding device 3. The LC circuit has a resonance frequency $f_2$ when the stopper 1 provided with the safeguarding device 3 is in a closure position of the container after a first opening thereof, which is less than its resonance frequency $f_2$ when the stopper 1 provided with the safeguarding device 3 is in the closure position of the container prior to the first opening thereof.

In order to check to see whether the container closed by the stopper 1 provided with the safeguarding device 3 has already been opened, it is thus enough to measure the resonance frequency of the LC circuit. For this purpose, a user may for example use a spectral analyzer coupled with a loop antenna having zero mutual inductance. The frequency for which the output is a maximum in amplitude corresponds to the resonance frequency. However, one could use any other apparatus able to measure the resonance frequency of the LC circuit of the safeguarding device 3 in order to check the condition of the closed bottle (or container) and verify whether it has already been opened or not.

In the previous description, each of the two parts 20 and 21 of the device comprises several elements assembled together. As a variant, each of the parts 20 and 21 may consist of a single monobloc piece, the only elements mounted after assembly of the two parts 20 and 21 able to move relative to each other being the piezoelectrical component 212 and the washer 205.

The two parts 20 and 21 of the device may be structurally different from those described with reference to FIGS. 1-5.

Figure 11A:
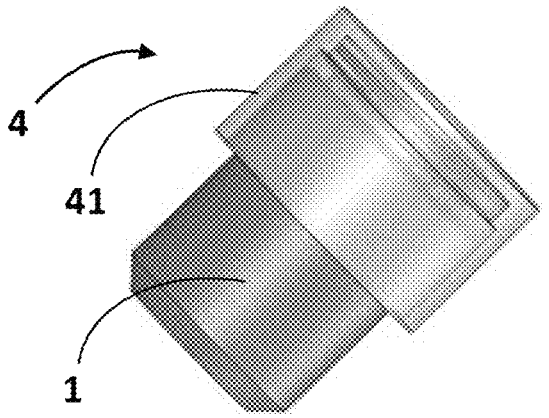
FIGS. 11A and 11B represent the secure sealing device of the invention in a fourth embodiment.
Figure 11B:
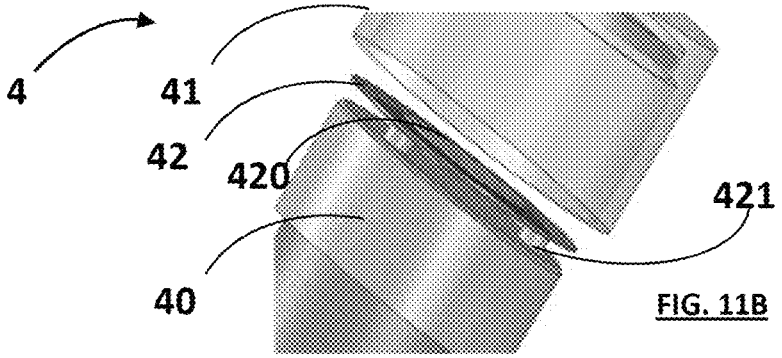

In FIGS. 11A and 11B, we show a fourth embodiment of the safeguarding device—having reference 4—comprising:

- a first lower part 40 designed to be joined to the stopper 1;
- a second upper part 41 designed to fit onto the first part 40, slightly movable in axial translation with respect to the first part 40, on which a printed circuit is arranged;
- a deformable pad 42 of disc shape placed between the first and the second part.

The pad 42 comprises a peripheral edge joined to the upper part 41 of the device 4 and portions closer to the centre of the pad which are joined to the lower part 40 of the device 4 by means of junction points 421. The pad 42 carries a piezoelectrical element 420 in the shape of a disc, of diameter less than that of the pad, arranged at the centre of the latter. When a user pulls on the upper part 41, this lifts the peripheral edge of the pad 42 and lowers the centre of the pad 42, this deformation of the pad 42 causing a deformation of the piezoelectrical element 420.

The pad 42 can be of bistable type. It then has two stable states. The application of a force to the pad makes it possible to switch it rapidly from one stable state to the other. This rapid deformation of the pad to switch from one stable state to the other is utilized to generate electrical energy by means of a piezoelectrical element. For example, in an initial state, the centre of the pad 42 is disposed above a reference plane passing through the contact zones between the pad 42 and the points 421, the perimeter of the pad 42 being beneath this plane. The pad 42 is then in a first stable state. When a user pulls upward on the upper part 41 of the device 4, the peripheral edge of the pad 42 moves above the reference plane due to the fact that its peripheral edge is joined to the upper part 41. Abruptly, under the effect of this deformation force, the pad 42 switches to a second stable state, the centre of the pad 42 then moving below the reference plane. This rapid deformation is utilized by the piezoelectrical element 420 to generate electrical energy. These steps are reversible. When one has pulled up on the upper part 41 and the pad 42 is in its second stable state, by pressing on the upper part 41 of the device, for example to restopper the bottle, this results in the switching of the pad 42 from its second stable state to its first stable state, and thus the generating of electrical energy.

We note that, in this embodiment, with a deformable pad 42 whose peripheral edge is joined to the upper part 41 of the device 4 and whose portions closer to the centre of the pad 42 are joined to the lower part 40 of the device 4 by means of points, the pad 42 advantageously plays the role of an end stop to limit the relative movement of the two upper 41 and lower 42 parts of the device.

Figure 12A:
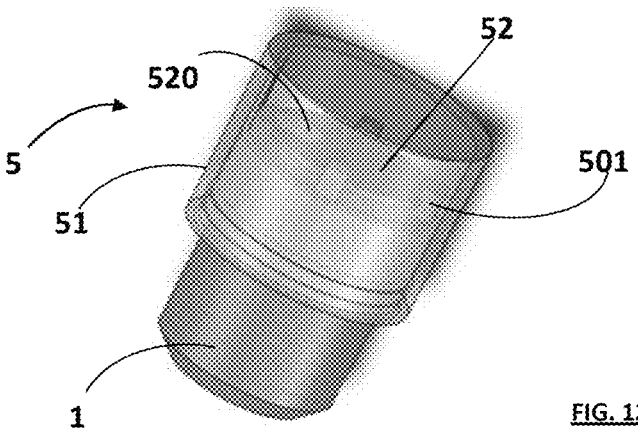
FIGS. 12A to 12C represent the secure sealing device of the invention in a fifth embodiment.
Figure 12B:
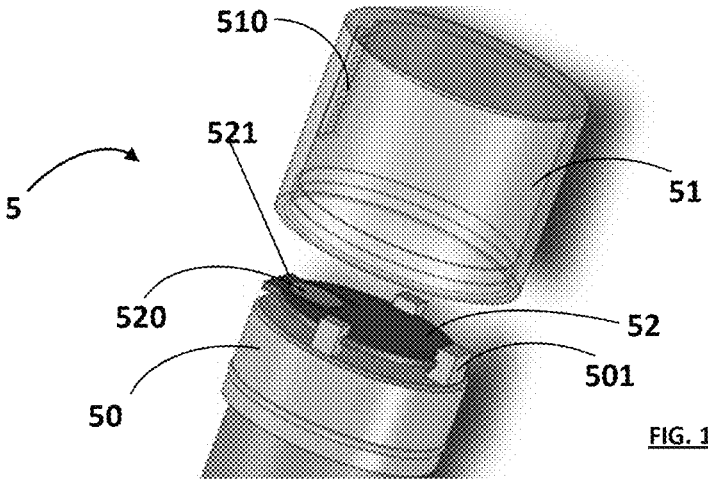
Figure 12C:
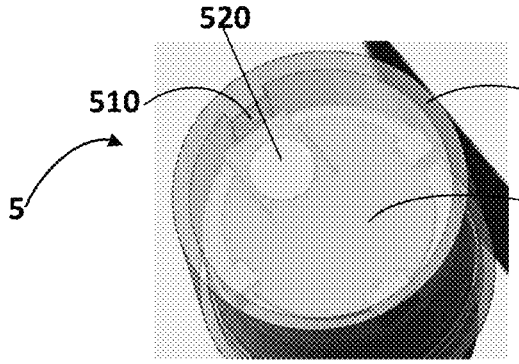

FIGS. 12A to 12C show a fifth embodiment of the safeguarding device of the invention—having reference 5—comprising:

- a first lower part 50 designed to be joined to the stopper 1;
- a second upper part 51 designed to fit onto the first part 50, slightly movable in axial translation with respect to the first part 50, on which a printed circuit is arranged;
- a deformable pad 52 of disc shape placed between the first and the second part 50, 51.

The pad 52 is fixed to the lower part 50 here by junction points 501, as represented in FIG. 12B, which position the pad 52 slightly away from the part 50, above the latter. The pad 52 carries a piezoelectrical element 520. The latter is advantageously positioned near the periphery of the pad 52.

The upper part 51 comprises, on its inner wall, a rack 510 designed to cooperate with a finger 521 of the pad 52, constituted by a projecting portion on the periphery of the pad 52.

Such a rack 510 is defined on all or part of the inner wall of the upper part 51. More precisely, with reference to FIGS. 12A to 12C, this rack 510 can be defined on a localized part of this inner wall by facing the finger 521 of the pad 52 so that this finger 521 cooperates with this rack 510 when the upper part 51 is entrained in translation with respect to the lower part 50. In an alternative, the rack 510 can be defined over the whole inner wall of the upper part 51. In this alternative, the finger 521 is always able to cooperate with the rack 510 even when the upper part 51 performs a displacement in rotation relatively to the lower part 50 around a central axis which is common to these two parts 50, 51.

It will be noticed moreover that in this fifth embodiment of the securing device 5, the second part 51 is mounted to be integrated in (or connected with) the first part 50 while being:

- movable in translation over the limited distance along of this central axis, and/or
- movable in rotation around this central axis which is common to these two parts 50, 51 notably by being free in rotation around said axis.

When the upper part 51 is entrained in translation with respect to the lower part 50, for example during an opening or a closing of the bottle, the finger 521 is displaced along the rack 510, generating vibrations of the pad 52. These vibrations cause deformations of a portion of the pad 52 and/or of the finger of the piezoelectrical element 520, which generates an electrical signal.

For example, in the closed position, the end of the finger 521 is positioned in a cavity of a high portion of the rack or above the height of the rack. When a user pulls up on the upper part 51, the end of the finger 521 successively encounters the cavities and the projections of the rack 510. This has the effect of deforming the finger 521 at each passage of a projection and of producing energy. This energy can be utilized, for example, by a piezoelectrical element disposed at a zone—of the finger 521 or a portion of the pad 52 near the finger 521—which is deformed, or by an electromechanical microsystem of piezoelectric beam type, to generate electrical energy. Thus, the vibratory mechanical energy is transformed into electrical energy. In the open position, the end of the finger is in a cavity of a low portion of the rack, or below the bottom of the rack.

Of course, the steps described above can be reversed.

Such a system makes it possible to generate a considerable quantity of electric energy. Even so, in order to count the number of openings and/or closings it is necessary to filter and/or process the electrical signals.

Preferably, the device 5 comprises an end stop designed to prevent the two parts 51 and 50 from becoming uncoupled.

The invention also relates to a secure sealing device for a container having a neck, comprising a stopper 1 designed to seal the neck, and a safeguarding device such as one of those 2, 3, 4, 5 defined above, assembled on the stopper 1.

The invention likewise relates to a container having a neck and a secure sealing device as defined above, sealing the neck. The container can be a bottle.

The invention finally relates to a container, especially a bottle, containing a wine or spirit.

The invention claimed is:

1. Safeguarding device designed to safeguard a container having a neck sealed by a stopper, the safeguarding device comprising:

a first and a second part, the first part being adapted to be integrated in the stopper and the first and second parts being joined in translation while allowing a limited relative movement of one of the parts with respect to the other in a translation direction when a traction force is applied to the safeguarding device in order to remove the stopper from the neck, and an electrical component disposed so that at least one electrical characteristic of the electrical component is modified during the relative movement of the first and second parts, wherein the electrical component is a piezoelectrical component integrated in one of the first and second parts, designed to be mechanically deformed by an excitation element integrated into the other of the first and second parts, during the relative movement of the first and second parts, so as to generate an electrical signal, wherein the excitation element comprises a portion joined to the first part, and the piezoelectrical component is carried by the second part, the portion joined to the first part and the piezoelectrical component being adapted to cooperate so that a peripheral radial outer edge of the piezoelectrical component is mechanically deformed by contact with a peripheral edge of the portion joined to the first part during a passage of the peripheral outer edge of the piezoelectrical component in front of the portion joined to the first part, during the relative movement of the first and second parts, wherein, during the passage of the peripheral radial outer edge of the piezoelectrical component in front of the portion joined to the first part, the peripheral radial outer edge of the piezoelectrical component passes from an initial position without contact with the peripheral edge of the portion joined to the first part, to an intermediate position of contact with the peripheral edge of the portion joined to the first part, to a final position without contact with the peripheral edge of the portion joined to the first part, wherein the initial position and the final position are on opposed sides of the intermediate position along the translation direction.

2. Safeguarding device according to claim 1, wherein the first part comprises a cylindrical portion adapted to fit onto the stopper and to be integrated with the stopper.

3. Safeguarding device according to claim 1, wherein the second part is mounted on an axis joined to the first part and able to move in translation for a limited distance along the axis.

4. Safeguarding device according to claim 3, wherein the second part is free in rotation around the axis.

5. Safeguarding device according to claim 3, wherein the portion joined to the first part of the excitation element comprises a washer, joined to the axis of the first part, and wherein the piezoelectrical component is positioned away from the axis, the washer and the piezoelectrical component being adapted to cooperate so that the piezoelectrical component is mechanically deformed by the washer during its passage in front of the washer, during the relative movement of the first and second parts.

6. Safeguarding device according to claim 5, wherein the second part is adapted to abut against the washer at the end of the relative movement of the first and second parts.

7. Safeguarding device according to claim 3, wherein the piezoelectrical component is in the form of a thin strip extending in a plane orthogonal to the axis of the first part and the strip is integrated with the second part.

8. Safeguarding device according to claim 1, wherein the piezoelectrical component is connected to a microcontroller designed to count the number of openings and/or closings of the container based on the electrical signal generated by the piezoelectrical component during each mechanical deformation.

9. Safeguarding device according to claim 8, wherein the microcontroller is electrically powered by the piezoelectrical component.

10. Safeguarding device according to claim 1, wherein the piezoelectrical component is connected to a transistor so as to gate the transistor with the electric energy generated by the piezoelectrical component when it is mechanically deformed.

11. Secure sealing device for a container having a neck, comprising a stopper designed to seal the neck, and a safeguarding device according to claim 1, assembled on the stopper.

12. Container comprising a neck and a secure sealing device according to claim 11, sealing the neck.

13. Container according to claim 12, which is in the form of a bottle.

14. Container according to claim 13, which contains a wine or spirit.

* * * * *